United States Patent [19]

Gripe

[11] Patent Number: 5,044,473

[45] Date of Patent: Sep. 3, 1991

[54] ELEVATOR WORK STATION APPARATUS

[76] Inventor: Thomas L. Gripe, 2719 El Rancho, Wichita, Kans. 67216

[21] Appl. No.: 408,281

[22] Filed: Sep. 18, 1989

[51] Int. Cl.[5] ..... B66B 1/26

[52] U.S. Cl. ..... 187/29.1; 182/146; 187/11; 187/27; 187/42

[58] Field of Search ..... 182/14, 145, 146, 148; 187/9 R, 11, 27, 28, 29.1, 42, 44, 45; 272/73

[56] References Cited

U.S. PATENT DOCUMENTS

| | | | |
|---|---|---|---|
| 775,373 | 11/1904 | Maxey | 182/145 X |
| 2,149,629 | 3/1939 | Rattigan | 187/27 X |
| 4,015,686 | 4/1977 | Bushnell, Jr. | 187/11 X |
| 4,353,544 | 10/1982 | Wiley | 187/11 X |

FOREIGN PATENT DOCUMENTS 0076181 4/1983 European Pat. Off. .

*Primary Examiner*—Joseph E. Valenza
*Assistant Examiner*—Dean A. Reichard
*Attorney, Agent, or Firm*—John Wade Carpenter

[57] ABSTRACT

An elevator work station having an upright back with a top and a bottom and a pair of stanchions that connect to the top and to the bottom. Each of the stanchions has a longitudinal slot that traverses the length thereof. A base is generally secured normally to the upright back, more particularly to the stanchions, for supporting the upright back in a generally upright position. A work station is slidably secured to and along the upright back, more specifically within the slots of the stanchions, such that the work station can travel generally from the top of the bottom of the upright back to the top thereof. A work station movement control is mounted to the work station. The elevator work station is provided with a pair of pedals which when pedalled in a predetermined direction can raise or lower the work station. The pedals control a cable that extends from the top of the upright back to a winch member that is controlled by the pedals. As the operator pedals the pedals and takes in the cable, the cable becomes shorter which causes the work station to travel up. The work movement control determines the direction of travel of the work station.

25 Claims, 9 Drawing Sheets

FIG. 4
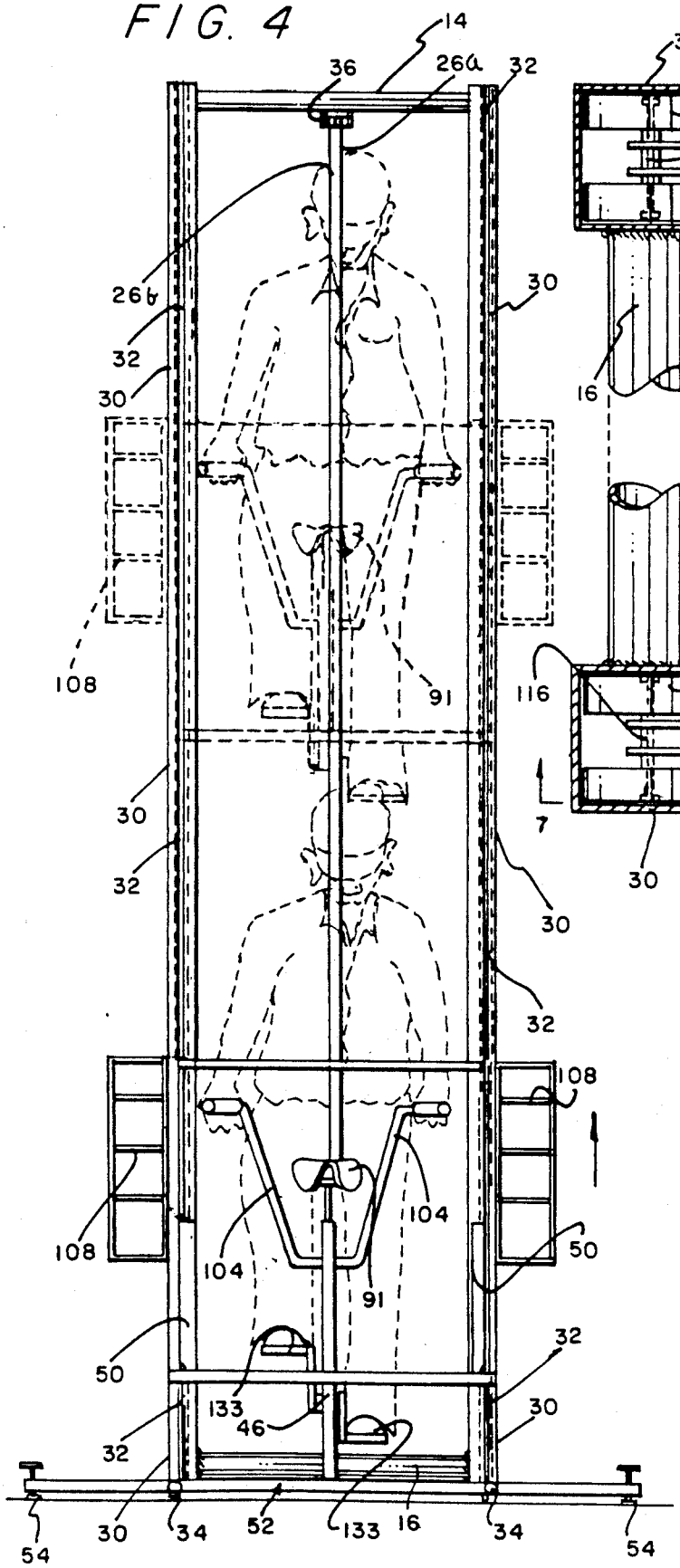
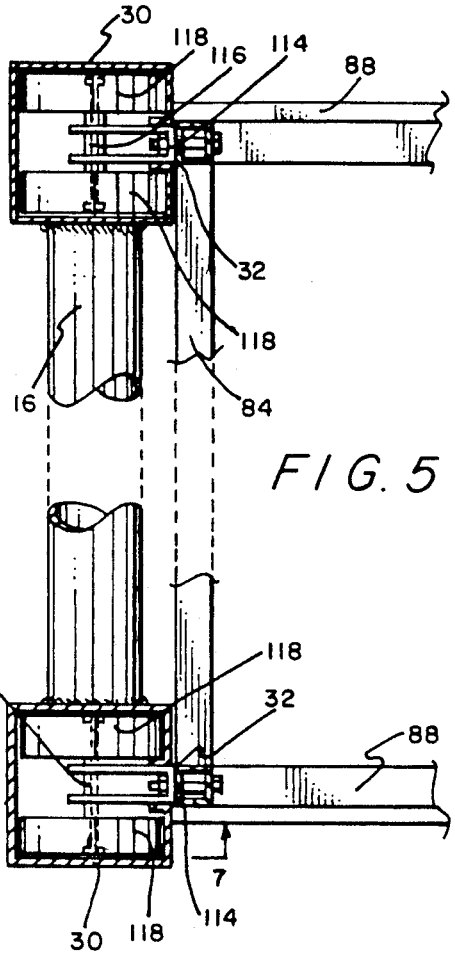
FIG. 5
FIG. 7
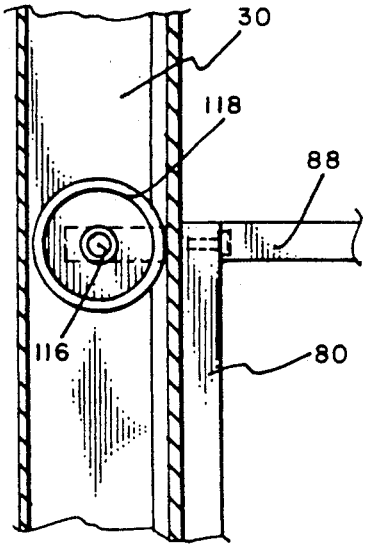

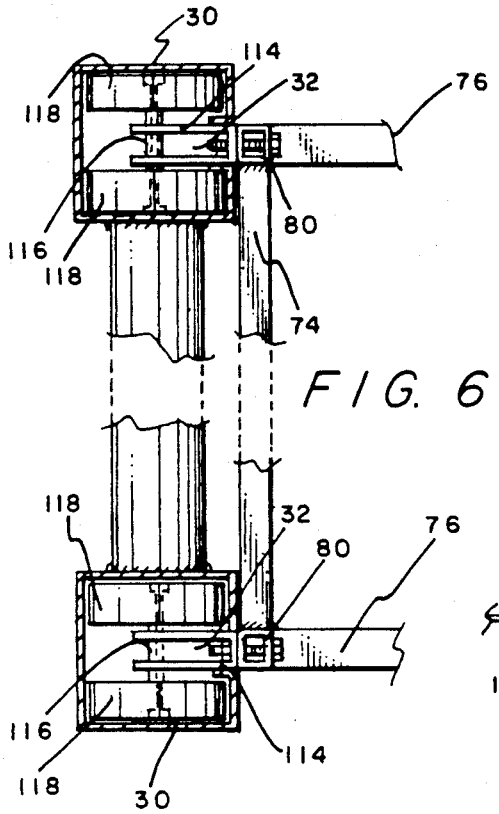
FIG. 6
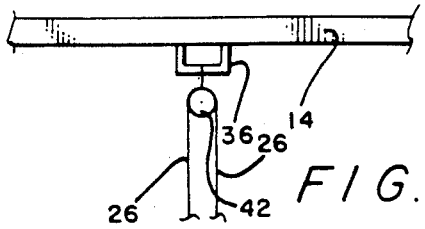
FIG. 11
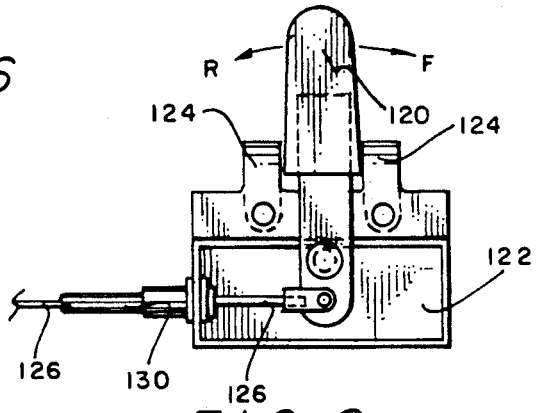
FIG. 8
FIG. 9
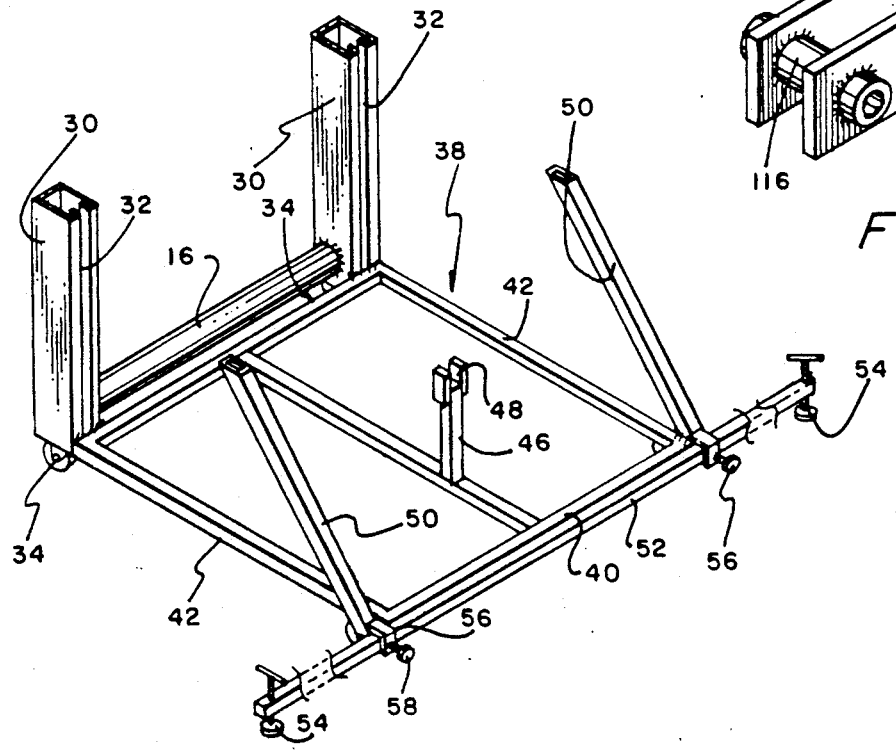
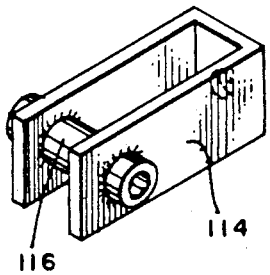
FIG. 10

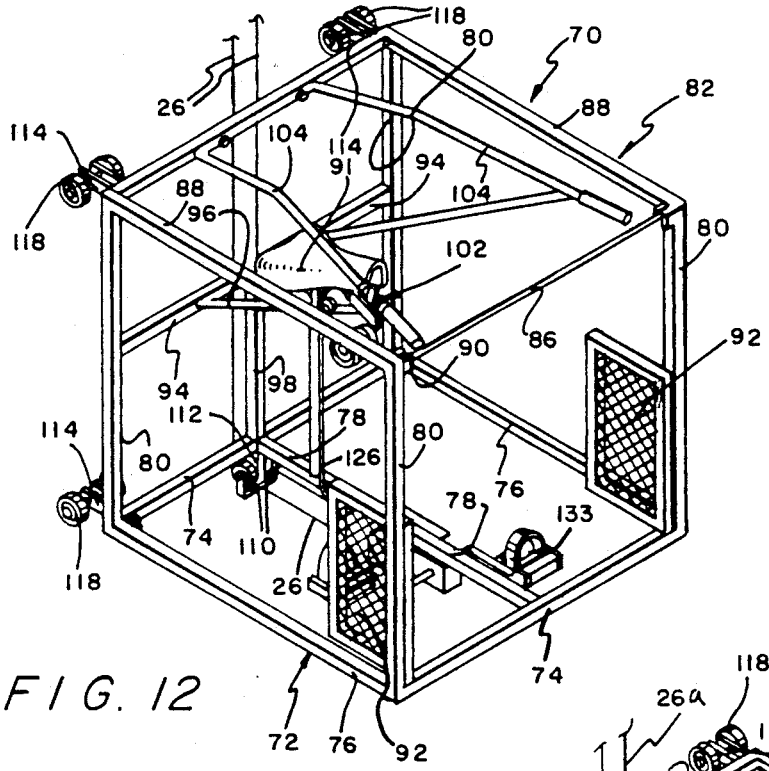
FIG. 12
FIG. 14
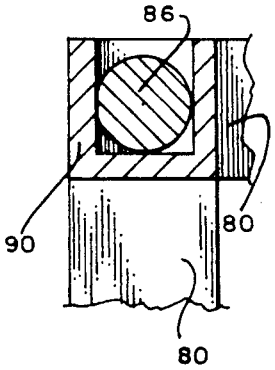
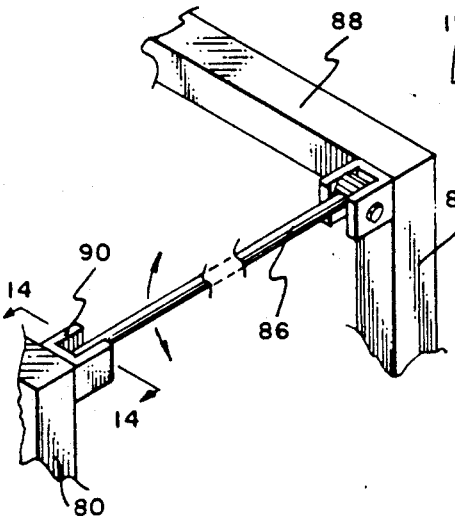
FIG. 13
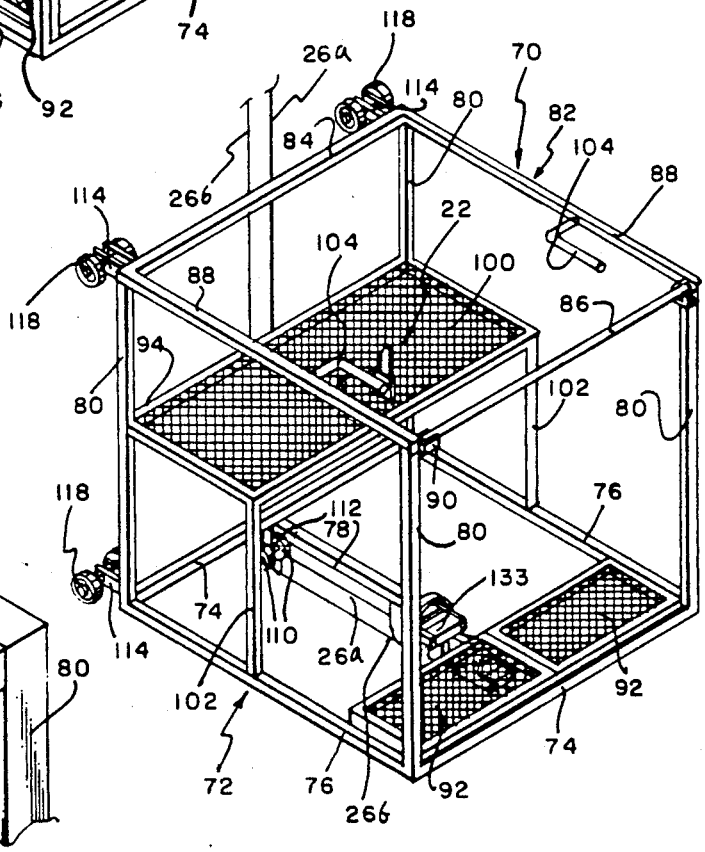
FIG. 15

FIG. 16
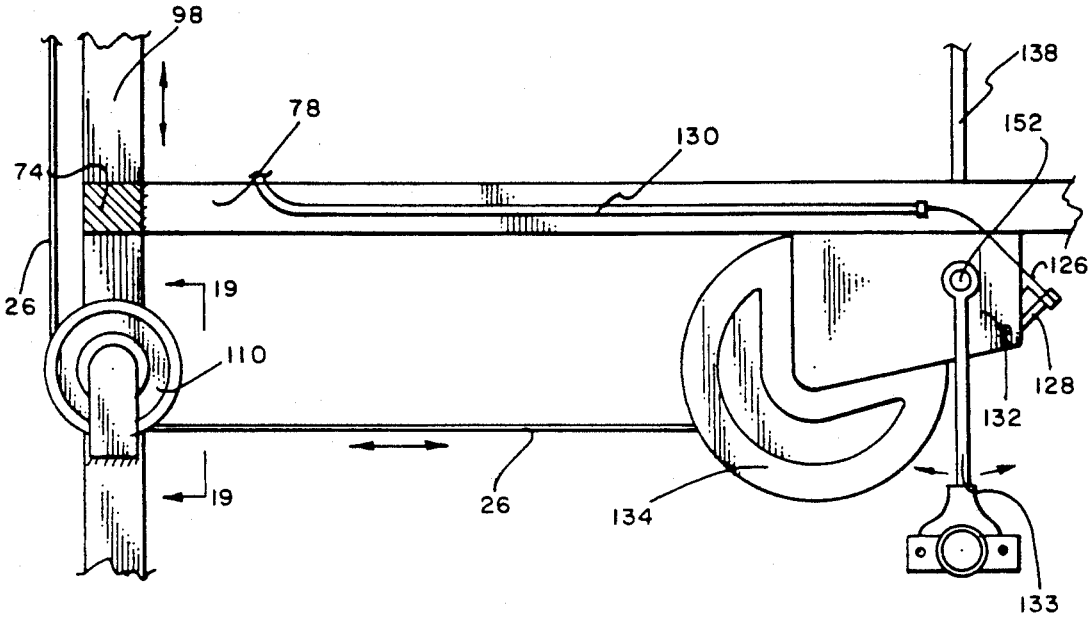
FIG. 17
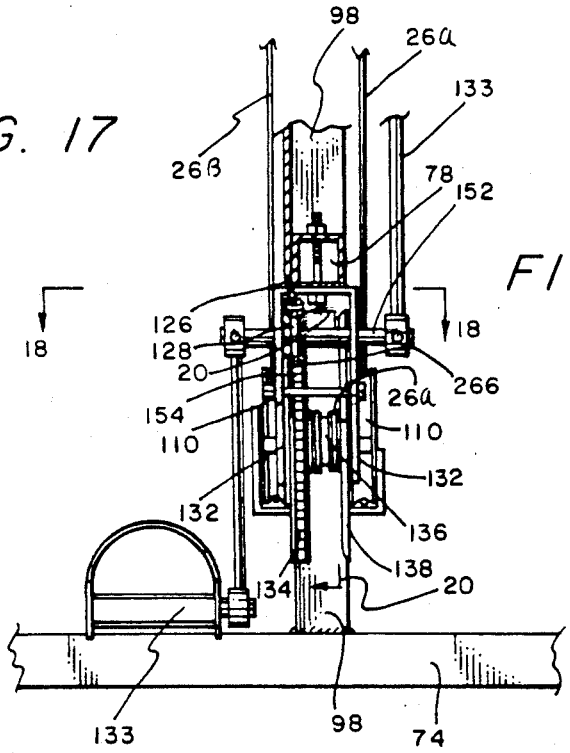
FIG. 19
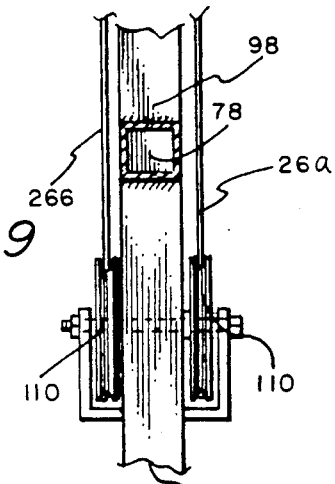
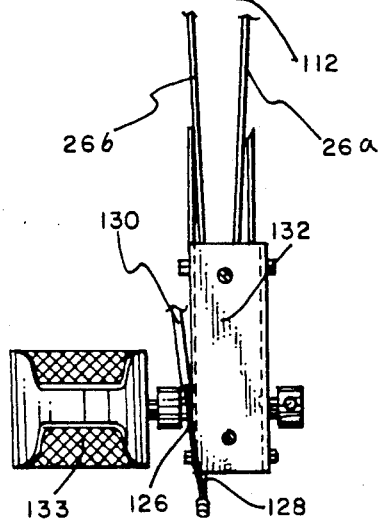
FIG. 18

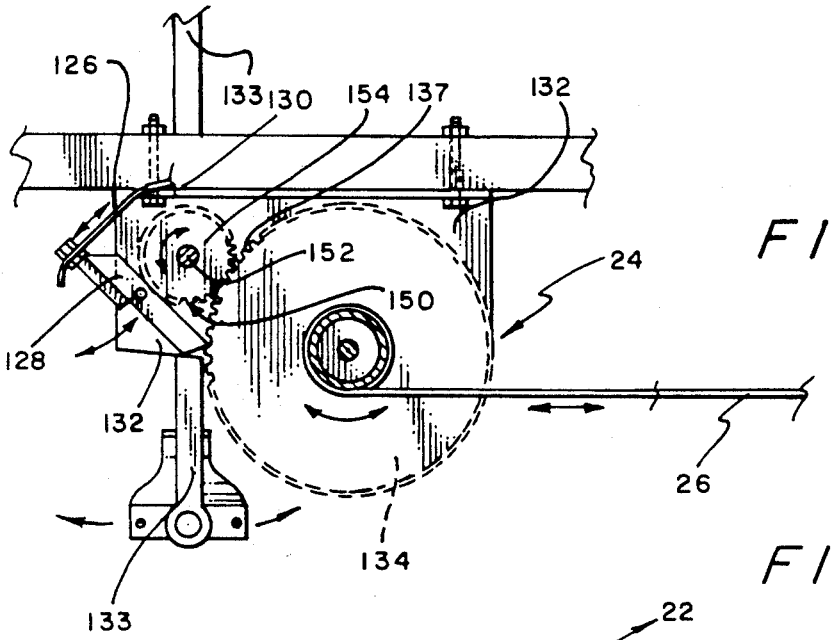
FIG. 20
FIG. 21
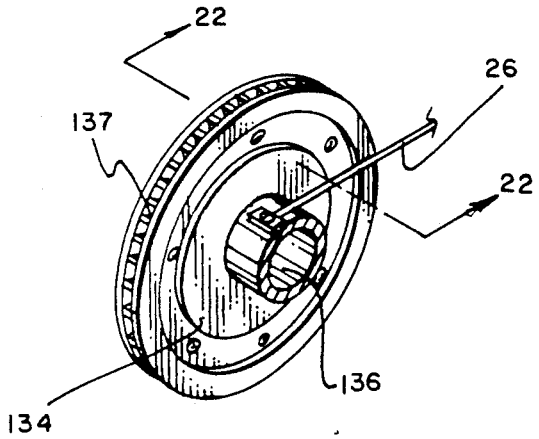
FIG. 22
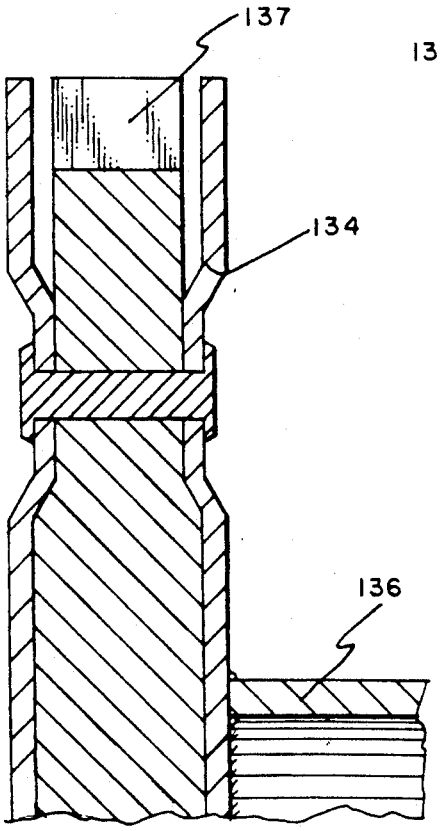
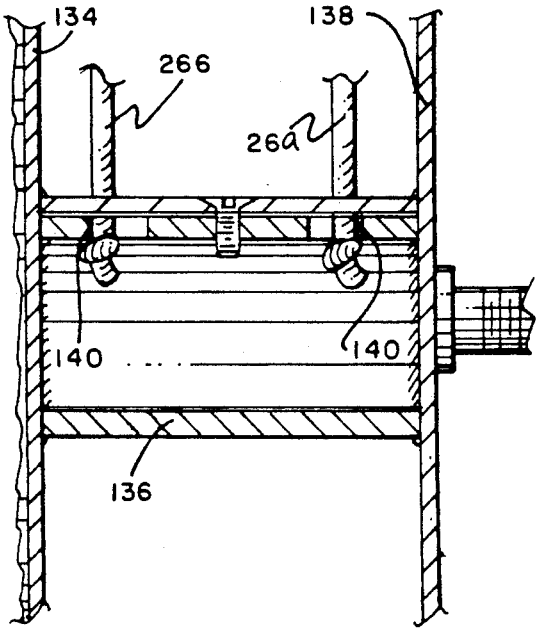
FIG. 23

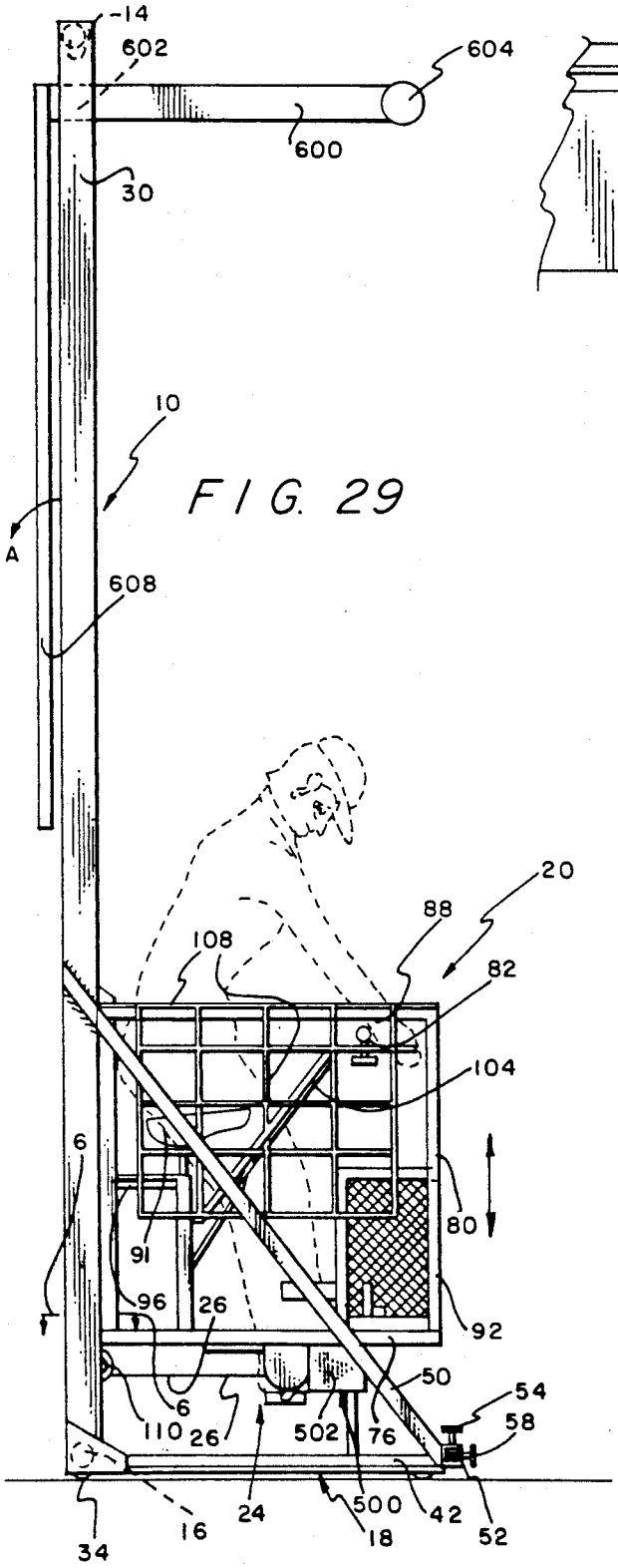
FIG. 29
FIG. 30
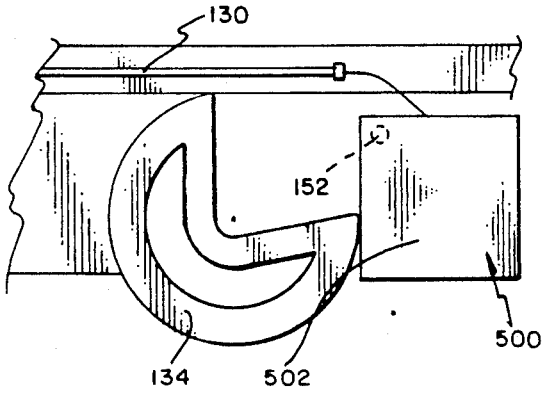
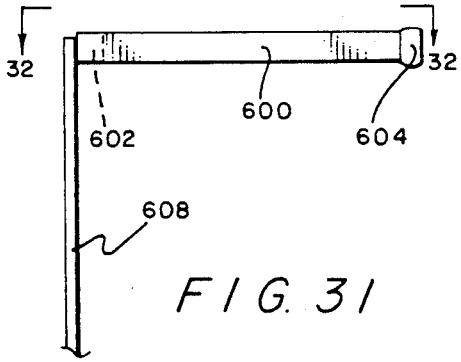
FIG. 31
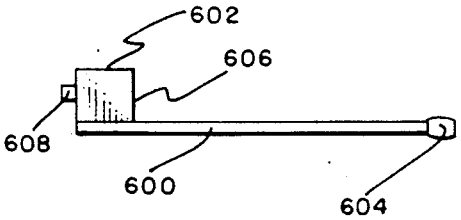
FIG. 32

ELEVATOR WORK STATION APPARATUS

BACKGROUND OF THE INVENTION

1. Field of the Invention

This invention is related to an elevator work station. More specifically, this invention provides a mechanical elevator work station where an operator can be elevated to a desired height.

2. Description of the Prior Art

The following U.S. patents were discovered in a patentability investigation: U.S. Pat. No. 3,168,937 to Redford et al.; U.S. Pat. No. 3,255,845 to Gardner; U.S. Pat. No. 3,424,271 to Michelson; and U.S Pat. No. 3,570,627 to Michelson. None of the foregoing prior art teaches or suggests the work station apparatus of this invention.

SUMMARY OF THE INVENTION

The present invention accomplishes its desired objects by broadly providing an elevator work station which includes a generally upright back having a top and a bottom and a pair of stanchions to which the top and the bottom connect. Each of the stanchions is generally hollow and has a longitudinal slot that traverses the length thereof. A base means is generally secured normally to the upright back for supporting the upright back in a generally upright position. More specifically, the base means connects to the pair of stanchions of the upright back. A work station means is slidably secured to and along the upright back, more specifically within the pair of slots of the pair of stanchions, such that the work station means can travel generally from the bottom of the upright back to the top thereof. A work station movement control means is mounted to the work station means. A means for raising and lowering the work station means is provided. The means for raising and lowering includes cables that are engaged to the top of the upright back, and the means for raising and lowering is controlled engagably by the work station movement control means.

It is therefore an object of the present invention to provide an elevator work station.

This object, together with the various ancillary objects and features which will become apparent to those skilled in the art as the following description proceeds, is attained by this novel elevator work station, a preferred embodiment being shown with reference to the accompanying drawings, by way of example only, wherein:

BRIEF DESCRIPTION OF THE DRAWINGS

FIG. 4 is a front elevational view of the work station;

FIG. 5 is a horizontal sectional view taken in direction of the arrows and along the plane of line 5—5 in FIG. 2;

FIG. 6 is a horizontal sectional view taken in direction of the arrows and along the plane of line 6—6 in FIG. 2;

FIG. 7 is a vertical sectional view taken in direction of the arrows and along the plane of lines 7—7 in FIG. 5;

FIG. 8 is a vertical sectional view taken in direction of the arrows and along the plane of line 8—8 in FIG. 3;

FIG. 9 is a partial perspective view of the base for the elevator work station;

FIG. 10 is a perspective view of the bracket which holds the bearing rollers that slidably, rotatably travel within the hollow stanchion members;

FIG. 11 is a partial front elevational view of the top of the upright back having a sheave secured to the lug bar;

FIG. 12 is a perspective view of the work station or cage where the operator resides;

FIG. 13 is a partial perspective view of the front of the work station or cage;

FIG. 14 is a vertical sectional view taken in direction of the arrows and along the plane of line 14—14 in FIG. 13;

FIG. 15 is a perspective view of another embodiment of the work station or cage where the operator resides;

FIG. 16 is a side elevational view of the foot pedals, winch mechanism and rear elevation rollers and cable;

FIG. 17 is a partial front view of the foot pedals and winch mechanism;

FIG. 18 is a horizontal sectional view taken in direction of the arrows and along the plane of line 18—18 in FIG. 17;

FIG. 19 is a vertical sectional view taken in direction of the arrows and along the plane of line 19—19 in FIG. 16;

FIG. 20 is a vertical sectional view taken in direction of the arrows and along the plane of line 20—20 in FIG. 17;

FIG. 21 is a perspective view of the large winch take-up gear with one side of the hub cut away;

FIG. 22 is an enlarged partial vertical sectional view taken in direction of the arrows and along the plane of line 22—22 in FIG. 21;

FIG. 23 is an enlarged partial vertical sectional view of the hub and the large winch take-up gear and the flange opposed thereto on the other side of the hub;

FIG. 29 is a side elevational view of another embodiment of the elevator work station;

FIG. 30 is a partial side elevational view of the gear sprocket/winch engaged to a motor means which drives the gear sprocket/winch for raising and lowering the elevator work station;

FIG. 31 is a partial side elevational view of a wall rest brace and a depending rod secured thereto for slidably raising and lowering the wall rest brace along a stanchion member; and FIG. 32 is a top plan view taken in direction of the arrows and along the plane of line 32—32 in FIG. 31.

DETAILED DESCRIPTION OF THE INVENTION

Figure 1:
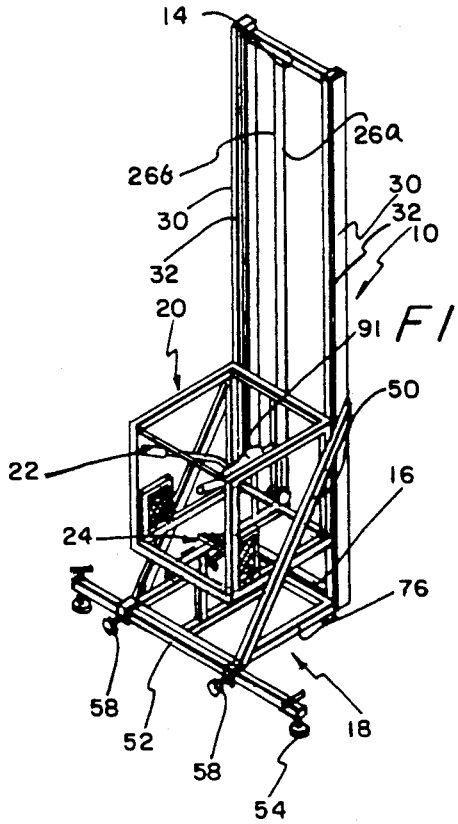
FIG. 1 is a perspective view of the elevator work station of this invention.
Figure 2:
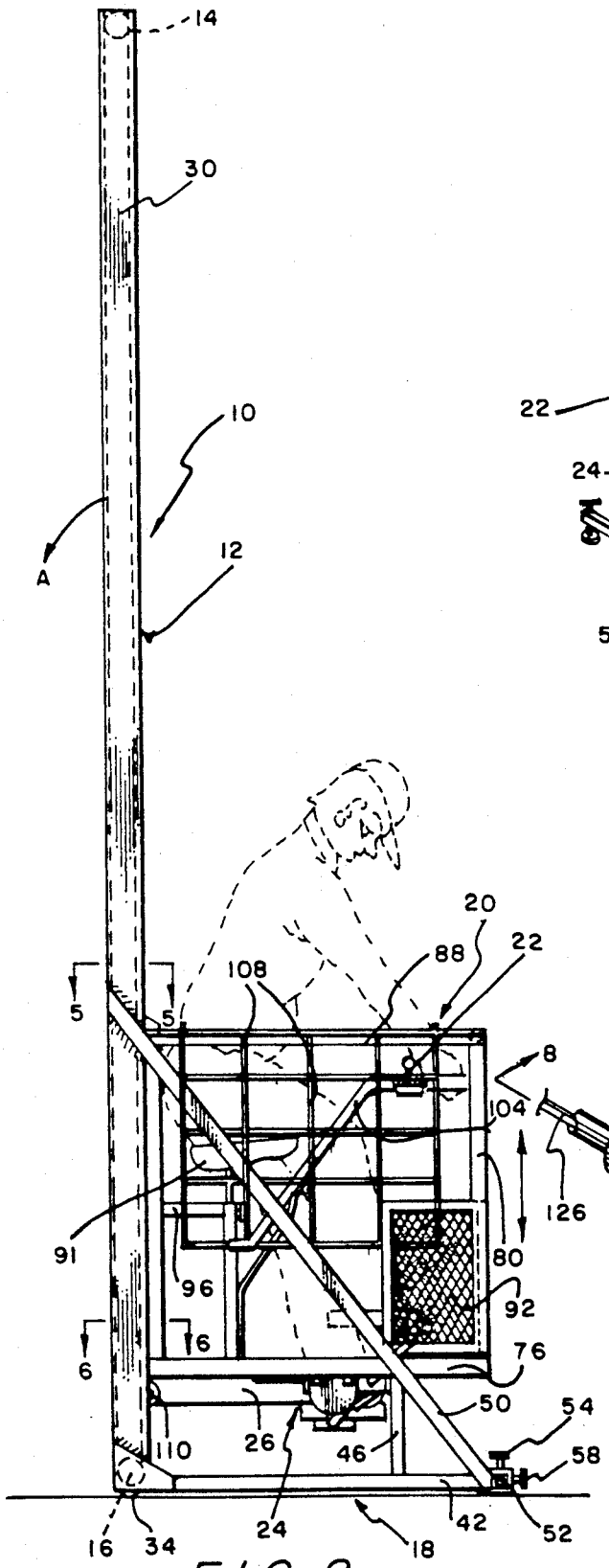
FIG. 2 is a side elevational view of the elevator work station.
Figure 3:
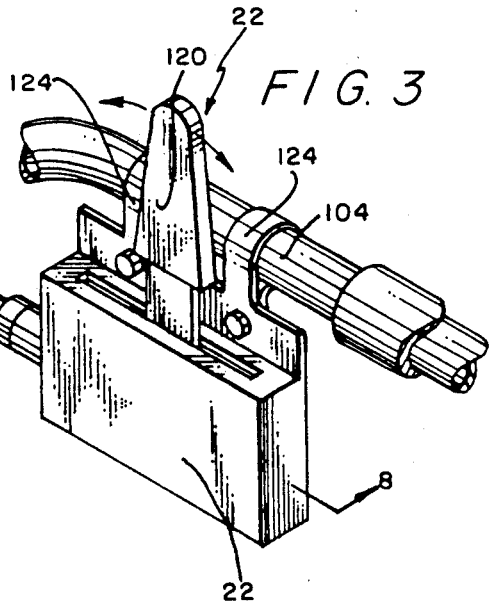
FIG. 3 is a perspective view of the hand operated control lever which controls the direction of movement of the work station.
Figure 24:
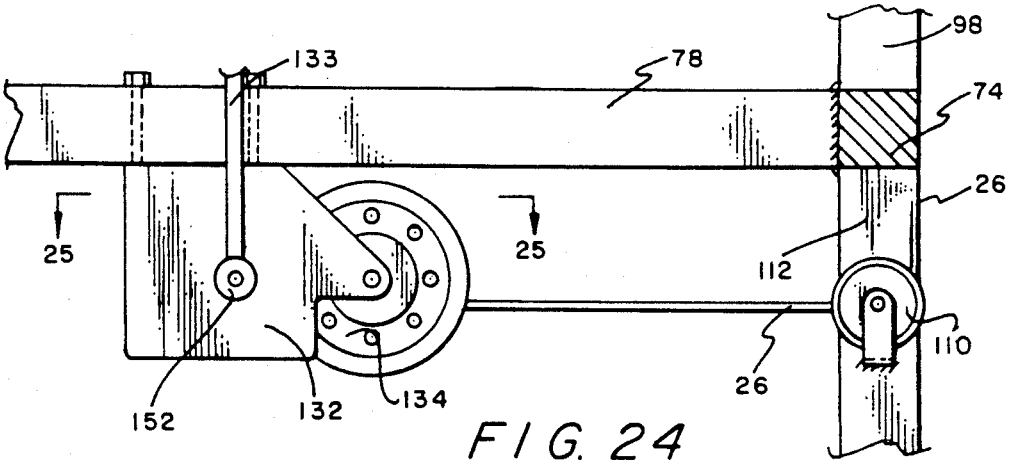
FIG. 24 is a side elevational view of the alternate embodiment to FIG. 16 employing worm and worm gear driving elements with the cable to cable rollers.

Referring in detail now to the drawings wherein similar parts of the invention are represented by like reference numerals, there is seen the elevator work station of this invention, generally represented as 10. Broadly, the elevator work station 10 comprises a generally upright back means 12 having a top 14 and a bottom 16; a base means, generally illustrated as 18, secured generally normal (i.e., at about a right angle) to the upright back means 12 (preferably to the bottom 16 thereof) for supporting the upright back means 12 in a generally upright position as best illustrated in FIGS. 1 and 2; and a cage or work station means, generally illustrated as 20, slidably mounted to and along the upright back means 12 such that the cage or work station means 20 can travel up and down the upright back means 12, more specifically towards the top 14 and bottom 16 of the upright back means 12. The elevator work station 10 additionally broadly comprises a work station movement control means, generally illustrated as 22 in FIG. 3, secured to or mounted on the work station means 20; and a means, generally illustrated as 24, for raising and lowering the work station means 20. The means 24 for raising and lowering the work station means 20 includes at least one line or cable 26 (more specifically, a cable 26 or a pair of cables **26*a*–26*b*) engaged to the top 14 of the upright back means 12 and is releasably engaged to the work station movement control means 22 (as best shown in FIG. 19) such that the control means 22 can control or dictate the direction of movement of the work station means 20**.

The upright back means 12, in addition to top 14 and bottom 16, includes a pair of hollow vertical stanchion members 30—30 which slidably engage the work station means 20 such that the work station means 20 can readily slide up and down the stanchions 30—30 in response to the operator engaging control means 22 and physically operating the means 24 for raising and lowering the work station means 20. Each stanchion member 30 has an open slot 32 (as best seen in FIG. 9) wherethrough a structural portion (to be identified below) of the work station means 20 slidably passes. Each stanchion 30 is supported by a wheel 34 (such as a caster wheel or the like) to facilitate the movement or transporting of the elevator work station 10 when the upright back means 12 is tilted in direction of the arrow A in FIG. 1. Attached underneath the top 14 is a lug bar 36.

In the embodiment of the invention in FIGS. 29–32, each stanchion member 30 has frictionally, slidably mounted thereto a wall rest brace 600 secured to a bracket member 602 that frictionally, slidably lodges along and on the outside of each of the stanchion members 30. Brace 600 has a crutch pad 604 on its end and bracket 602 has an opening 606 that aligns with open slot 32 of each stanchion 30. A depending bar 608 mounts to the rear of the bracket 602 such that the operator can raise or lower the bracket 602 (and the wall rest brace 600) along the longitudinal length of the respective stanchion 30. The wall rest brace 600 operates as a safety means should the elevator work station 10 start to fall forward. The crutch pad 604 would contact a wall, or the like, to stop the forward fall. Also, the wall rest brace 600 could act as a guide or distance adjuster for setting the work station 10 a certain distance from a wall or the like.

The base means 18, as best seen in FIG. 9, comprises a base frame, generally illustrated as 38 (see FIG. 9), having a pair of opposed ends 40—40 and a pair of opposed sides 42—42 which secure to the opposed ends 40—40. A base cross member 44 interconnects the pair of opposed ends 40—40. A base brace member 46 mounts vertically on the base cross member 44 and has a bifurcated head 48. Brace member 46-head 48 supports the work station means 20 in an elevated position off of the base frame 38 when not in use. A pair of cross braces 50—50 connect from the front ends of the sides 42—42 to the sides of the stanchions 30—30. Either attached along the front end 40 or flushed slidably against the front end 40 is a base cross-support 52 having a pair of threaded feet 54—54 threadably passing therethrough on opposed ends of the cross-support 52. An open bracket member 56, with a threaded engager 58 passing therethrough, is secured to each of the cross-braces 50—50 such that the pair of open bracket members 56—56 slidably receives therethrough the cross-support 52 when the base cross-support 52 is merely flushed slidably against the front end 40. Tightening down each of the engagers 58 affixes the cross-support 52 into a desired position.

Figure 27:
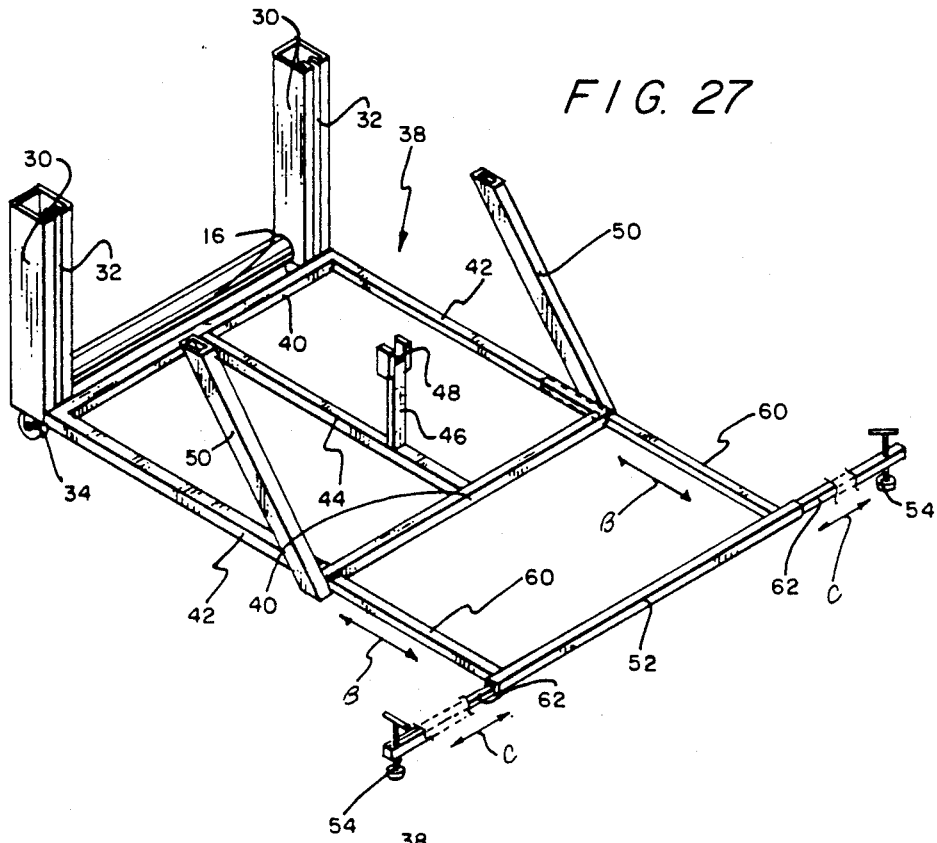
FIG. 27 is a partial perspective view of another embodiment of the base for the elevator work station.
Figure 28:
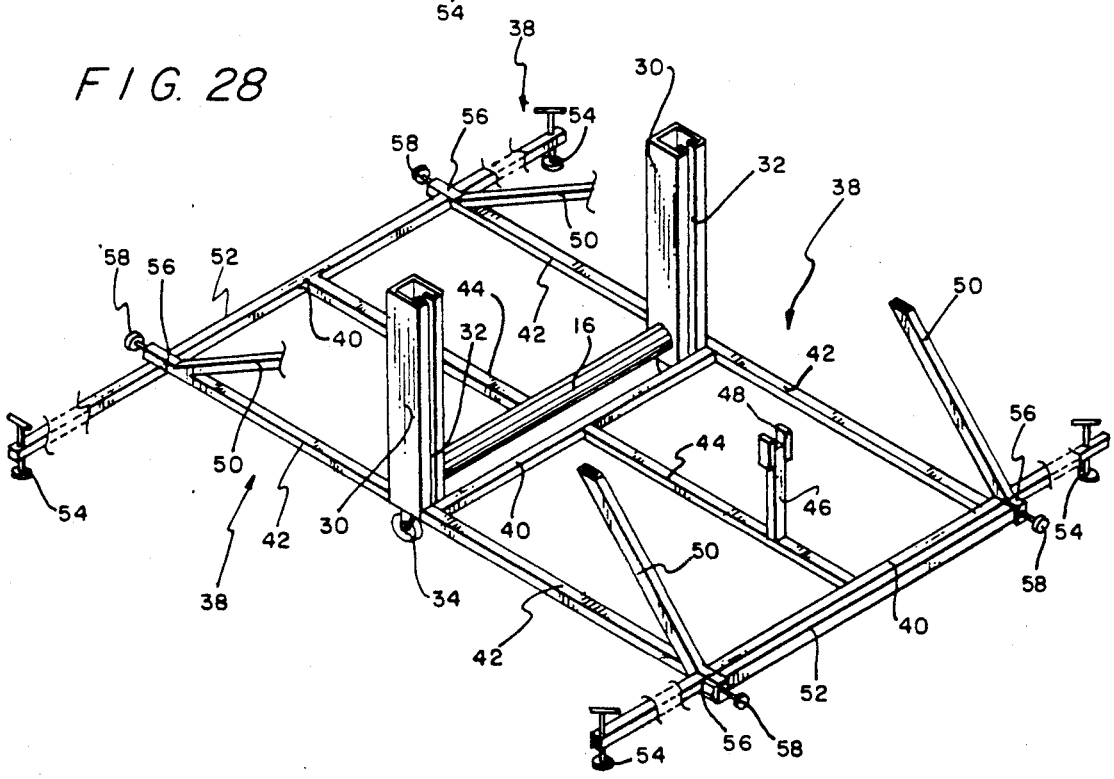
FIG. 28 is yet another perspective view of yet another embodiment of the base for the elevator work station.

In another embodiment for the base means 18, as best illustrated in FIG. 27, the opposed sides 42—42 are hollow and open for slidably receiving telescopically respectively a pair of slide extension members 60—60 which secure to the cross-support 52. Similarly, the cross-support 52 is hollow and open on both ends for slidably receiving telescopically a pair of support extension members 62—62, each of which has the threaded foot 54. The side extension members 60—60 move in direction of the arrows B—B and the support extension members 62—62 move in direction of the arrows C—C, all for providing additional stability to the elevator work station 10. FIG. 28 is another embodiment of the elevator work station 10 having optionally another base means 18 (including base frame 38) on the other side of the stanchion members 30—30 to give yet further stability to the elevator work station 10. It is readily apparent to the artisans that the embodiment of the base frame 38 in FIG. 27 may also be situated on the other side of the stanchion members 30—30 in FIG. 27, and that the base means 18 embodiments of FIGS. 9 and 27 may be combined; that is, one side of the stanchion members 30—30 having the base means 18 embodiment of FIG. 9 and the other side having the embodiment of FIG. 27.

The cage or work station means 20 comprises a frame structure, generally illustrated as 70 in FIG. 12 and comprising a lower rectangular frame 72 having a pair of lower opposed ends 74—74 and a pair of lower opposed sides 76—76 connected to the opposed ends 74—74. A lower cross-support member 78 interconnects the opposed ends 74—74. Bound in an upright manner at the respective corners of the lower rectangular frame 72 is an upright corner frame member 80, making a total of four (4) corner frame members 80—80—80—80 which function to support an upper rectangular frame 82 comprising a pair of opposed ends 84, 86 and a pair of upper opposed sides 88—88 which connect to upper opposed end 84. A yoke member 90 is attached to the juncture point of one upright corner frame member 80 with one of the upper opposed sides 88. Pivotally connected directly across to the opposed juncture point of another upright corner frame member 80 with another of the upper opposed sides 88 is upper opposed end 86 which is capable of being pivoted in and out of yoke member 90 to allow the operator into and out of the cage or work station means 20. Included within the cage or work station means 20 is a support area for the operation. In the embodiment of the work station means 20 in FIG. 12, the support area includes a bicycle seat 91 secured upright to the lower cross-support member 78 and a pair of lower platforms 92—92 pivotally connected to the lower opposed sides 76—76 where the operator can respectively sit and rest his or her feet. Interconnected across the pair of rear upright corner frame members 80—80 is a rear frame brace 94 which is capable of supporting or sturdying the seat 91 via bracket 96 along with upright support 98 which is interconnected between the rear frame brace 94 and the rear lower opposed end 74 as best seen in FIG. 12. In the embodiment of the work station means 20 in FIG. 15, the seat 91 is replaced by a sitting platform 100 supported in the rear by the rear frame brace 94 and in the front by a pair of front platform supports 102—102 which are connected thereto and supported by the pair of lower opposed sides 76—76. Both of the embodiments in FIGS. 12 and 15 include a pair of handle bars 104—104 which in FIG. 12 connect to and extend respectively from the upper opposed end 84 and which in FIG. 15 connect to and extend respectively from the pair of upper opposed sides 88—88. A portion (the part illustrated in FIG. 3) of the work station movement control means 22 connects to one of the handle bars 104. Both embodiments may include a pair of baskets 108—108 that secure to and depend from the pair of upper opposed sides 88—88 as illustrated in FIG. 4. Both embodiments further include a pair of guide rollers 110—110 rotatably supported by a bracket 112 (see FIG. 12) that secures underneath one of the opposed ends 74. The guide rollers 110—110 define a circular rotatable sheave such as to guide the cable 26 or pair of cables **26*a*-26*b*. Connected to the lower nut angular frame 72 (e.g. to the opposed ends 74) and to the upper rectangular frame 70 or to the rear upright corner frame members 80—80 is a generally horseshoe shaped bracket 114, as best shown in FIG. 10. A shaft 116 presses the opposed arms of the bracket 114 such as to rotatably support on opposed sides thereof a pair of roller bearings 118—118. The two pairs of brackets 116—116 slidably pass through the pair of slots 32—32 of the two stanchions 30—30 such that the roller bearings 118—118 can travel within the hollow stanchions 30—30 and against the inside walls thereof. When the work station means 20 is normally driven up and down, the four bracket 114-roller bearings 118—118 combinations keep the work station means 20 stable, aligned and slidably flushed to the pair of upright stanchions 30—30**.

The work station movement control means 22 comprises a manually operated control lever 120 pivotally mounted in a lever housing 122 that includes a pair of loops 124—124 wherethrough a handle bar 104 slidably passes. One end of a control cable 126 secures to a lower part of the control lever 120. The other end of the control cable 126 connects to a sprocket lever 128 (see FIGS. 16 and 20). A conduit 130 connects to lever housing 122 and provides a housing for the control cable 126. The sprocket lever 128 pivotally connects to one of two support plates 132—132 that connects dependently to the cross-support member 78 and functions to control the direction of rotation of a gear sprocket 134 having a plurality of teeth 137 (see FIG. 21). A hub 136 is bound generally concentrically to the gear sprocket 134. Attached to an opposed end of the hub 136 and opposed to the gear sprocket 134 in a coaxial fashion is a sprocket plate 138. The hub 136 has a plurality of apertures, more specifically two apertures 140—140 (see FIG. 23), wherethrough the cable 26 or cables **26*a*-26*b* pass to be knotted at an end for retaining the cable 26 or cables 26*a*-26*b* to the hub 136. In one embodiment of the invention, a single cable 26 is secured within one aperture 140, passes around one of the guide rollers 110 and up to and around a sheave 142 (see FIG. 11) suspended from the lug bar 36, and down to and around the other guide roller 110 and is bound within the other aperture 140. In the more preferred embodiment of the invention, cable 26*a* is secured within one aperture 140 and passes around one of the guide rollers 110 and up to the lug bar 36 where it connects thereto (as illustrated in FIG. 4); and cable 26*b* connects within the other aperture 140 and passes around the other guide rollers 110 and also up to the lug bar 36 where it too connects thereto (as also illustrated in FIG. 4). The latter embodiment is the more preferred because of a built-in safety factor; that is, should either cable 26*a* or 26*b* break, the remaining one cable is still intact to prevent the work station means 20 from free falling. Geared to the gear sprocket 134 is a means for rotating the gear sprocket 134, generally illustrated as 150**.

Figure 25:
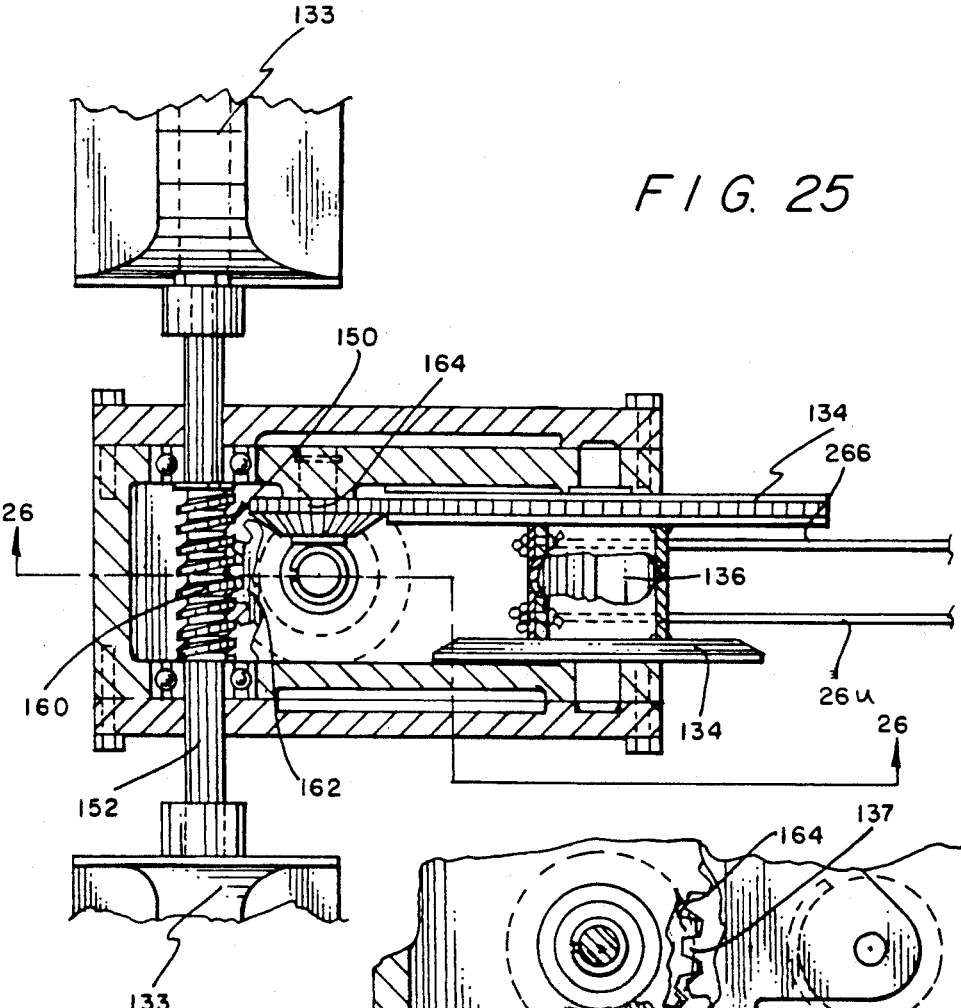
FIG. 25 is a horizontal sectional view taken in direction of the arrows and along the plane of line 25—25 in FIG. 24.
Figure 26:
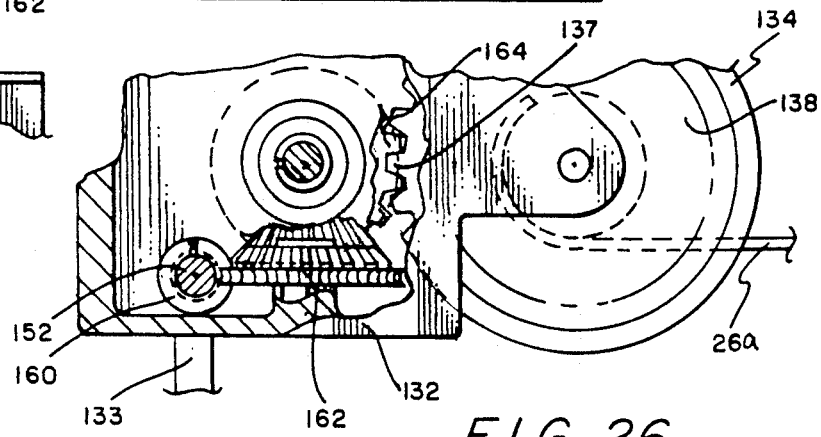
FIG. 26 is a vertical sectional view taken in direction of the arrows and along the plane of line 26—26 in FIG. 25.

The means 150 for rotating the gear sprocket 134 comprises two preferred embodiments. In the embodiment of FIGS. 17 and 20, the means 150 has a shaft 152 that rotatably passes through support plates 132—132. A pair of foot operated pedals 133—133 connects to the shaft 152 such that when the operator pedals the pedals 133—133, shaft 152 turns or rotates. Attached to the shaft 152 is a sprocket 154 which gears the teeth 136 of gear sprocket 134. As the shaft 152 turns, sprocket 154 also turns, causing the gear sprocket 134 to rotate the hub 136 to take up cable 26 or cables **26*a*-26*b* in order to raise or elevate the work station means 20. In the embodiment of FIGS. 25 and 26, the means 150 includes a worm gear 160 integrally formed with shaft 152. Geared to worm gear 160 is a horizontal gear 162 which rotatably mounts on and to support plate 132. A vertical gear 164 is also rotatably mounted to and on support plate 134 and is geared to both the horizontal gear 162 and to the gear sprocket 134 to transmit rotary power and movement from the horizontal gear 162 to the gear sprocket 134. As shaft 152 turns in this embodiment of the invention, the integral worm gear 160 also turns causing the horizontal gear 162 to also turn. Turning with the horizontal gear 162 is the vertical gear 164 which causes the gear sprocket 134 to turn and rotate the hub 136 to take up cable 26 or cables 26*a*-26*b* in order to raise or elevate the work station means 20, similar to the embodiment in FIGS. 17 and 20**.

In the embodiment of the invention in FIGS. 29-32, shaft 152 is coupled (by any suitable means) to a drive means (e.g. motor or the like) 500, which is preferably an electric or mechanical motor 502 that can be activated (e.g. energized or the like) via cable 126 and lever 120. When the motor 502 is activated to turn shaft 152 in a predetermined direction, shaft 152 turns in the predetermined direction to take up or let out cable 26 or cables **26*a*—26*a*, thus raising or lowering the work station means 20**.

With continuing reference to the drawings for operation of the elevator work station, an operator who desires to be elevated a certain distance above the ground, enters the cage or work station means 20 by elevating pivotally the upper opposed end 86. The operator either sits on the bicycle seat 91 or on the sitting platform 100, depending on which preferred embodiment of the invention is employed. After the operator disposes his, or herself as such, the operator engages the pair of pedals 133—133 with his or her feet such as to be in a posture very similar to one pedaling a bicycle. Subsequently, the operator pushes lever 120 forward and in direction of the arrow F in FIG. 8. This causes the cable 126 to produce a counterclockwise rotation effect on sprocket lever 128, driving the lower part of the sprocket lever into engagement with the teeth 137 of the gear sprocket 134. As the operator produces a pedaling motion with the pedals 133—133, either gear 154 or the combination of worm gear 160-gear 162-gear 164, depending on which embodiment of the gear arrangement is employed, causes the gear sprocket 134 to start turning and taking up the cable 26 or cables **26*a*-26*b* around the hub 136 thereof. As the gear sprocket 134 rotates, a ratcheting effect or action is caused by the lower part of sprocket lever 128 on the teeth 137 of the gear sprocket 134. With the lower part of the sprocket lever 128 engaging the teeth 136 of the gear sprocket 134, a safety factor is built in for the operation of the elevator work station 10. More particularly, should the operator lose his or her footing or engagement with the pedals 133—133, the lower end of the sprocket lever 128 engaged to the teeth 136 of the gear sprocket 134 prevents the gear sprocket 134 from freely rotating, which in turn would cause the pair of pedals 133—133 to freewheel. The free rotation of the sprocket lever 128 and/or freewheeling of the pedals 133—133 would cause the cable 26 (or cables 26*a*-26*b*) to unwind from around the hub 136, which inherently would extend the length of the cable 26 or cables 26*a*-26*b* and cause the work station means 20 containing the operator to fall. As the work station means 20 is driven up by the pedaling action of the operator, the four bracket 114-roller bearings 118—118 combinations keep the work station means 20 stable, aligned and slidably flushed against the pair of upright stanchions at 30—30. As previously indicated, the brackets 116 slidably pass through the pair of slots 32—32 of the two stanchions 30—30 such that the roller bearings 188—118 on the respective brackets 116 can travel within the hollow stanchions 30—30** and against the inside walls thereof.

After the operator has pedaled the work station means 20 to a desired height, the platforms 92—92 are pivoted downwardly to provide a place for the operator to stand and perform the desired task functions. After the operator has finished his or her desired task, the operator takes a seat back on the seat 91 or the sitting platform 100. The control lever 120 is pulled in direction of the arrow R in FIG. 8. This causes the cable 126 to place a clockwise rotation on the sprocket lever 128 in FIG. 20. Such a clockwise rotation disengages the lower end of the sprocket lever 128 with the teeth 137 of the gear sprocket 134. It is important at this point in time that the operator maintains controlled engagement with and on the foot pedals 133—133 as a braking action or function to prevent the gear sprocket 134 from freewheeling and causing the work station means 20 to descend at a rate of speed which is less than desirable. More specifically, the operator should back pedal the pedals 133—133 such a to place a controlled biased clockwise rotation on the gear 154 (in FIG. 20) or gear 164 (in FIGS. 25 and 26) depending on which embodiment of the gear assembly is employed. The controlled biased clockwise rotation of either of these respective gears causes the gear sprocket to rotate counterclockwise (see FIGS. 20 and 26). Controlled biased clockwise rotation of gear 154 (in FIG. 20) or gear 164 (in FIG. 26) is a controlled braking function and is obtained by the operator placing or urging a counterclockwise rotational force against the gear 154 or gear 164 with the aid of the pair of pedals 133—133. It is apparent that should the operator disengage his or herself from pedals 133—133, the weight of the work station means 20 including the operator will place a freewheeling counterclockwise rotation (with respect to FIGS. 20 and 26) on the gear sprocket 134. Such counterclockwise free rotation is transmitted to the gear 154 or gear 164 in the form of an uncontrolled, freewheeling clockwise rotation with respect to gear 154 or gear 164. Furthermore, the uncontrolled clockwise rotation of gears 154 or 164 would cause the pedals 133—133 to freewheel. Thus, freewheeling of the pedals 133—133 can be prevented by the operator maintaining foot control on the pedals 133—133 and producing or urging a generally counterclockwise force against the gear 154 or gear 164. Obviously, in order to lower the work station means 20 gradually, the counterclockwise force or urging on gear 154 or gear 164 would have to be less of a force than the clockwise force that is being imparted to gear 154 or gear 164 by the counterclockwise force (as viewed in FIGS. 20 and 26) produced on the gear sprocket 134 and having a magnitude directly proportional to the weight of the work station means 20 including the operator.

The operator can gradually lower his or herself down within the work station means 20 by maintaining a counterclockwise biasing force against gear 154 or gear 164 through a controlled biased back pedalling action which prevents freewheeling of the pedals 133—133 along with freewheeling of gear 154, or gear 164 and the gear sprocket 134. After the operator within the work station means 20 reaches ground elevation, the bar 86 can be pivoted upwardly such that the operator can exit the work station means 20. As previously indicated above, the stability of the base means 18 can be increased by any of the various embodiments as depicted in FIGS. 9, 27 and 28, or any of the combinations thereof. By increasing the stability on the base means 18, there will be a decreased tendency in the elevator work station 10 from tilting over, especially when the work station means 20 containing the operator is at the very most top of the upright back means 12.

While the present invention has been described herein with reference to particular embodiments thereof, a latitude of modification, various changes and substitutions are intended in the foregoing disclosure, and it will be appreciated that in some instances some features of the invention will be employed without a corresponding use of other features without departing from the scope of the invention as set forth.

I claim:

1. An elevator work station comprising a generally upright back having a top and a bottom, a base means generally secured normally to said upright back for supporting said upright back in a generally upright position; a work station means for supporting an operator and slidably secured to and along said upright back such that said work station means can travel generally from the bottom of said upright back to the top thereof; a work station movement control means for controlling the movement of said work station means and mounted to said work station means; and means for raising and lowering said work station means, said means for raising the lowering being engaged to said top of said upright back and controlled engageably by said work station movement control means; said upright back comprises a pair of hollow stanchion members with each stanchion member having a hollow structure defining an open slot wherethrough a structural portion of the work station means slidably passes such that the work station means can readily slide up and down the pair of stanchions; said means for raising and lowering said work station means comprises a gear sprocket, a hub bound to said gear sprocket, a pair of cables connected to said hub and to said top of said upright back; and a means for rotating said gear sprocket; said work station means includes a pair of rotating guide rollers wherearound said pair of cables pass; said means for rotating said gear sprocket comprises a pair of pedals geared t said gear sprocket; and said means for rotating said gear sprocket comprises a worm gear engaged by the pair of pedals, a horizontal gear geared to the worm gear and a vertical gear geared to the horizontal gear and to the gear sprocket.

2. The elevator work station of claim 1 additionally comprising a wheel member secured to said stanchion, and a lug bar secured to said top of said upright back.

3. The elevator work station of claim 2 additionally comprising a sheave member secured to said lug bar.

4. The elevator work station of claim 1 wherein said base means comprises a base frame having a pair of opposed ends and a pair of opposed sides secured to the opposed ends, a base cross member connected to said pair of opposed ends, and a base brace member mounted generally vertically on the base cross member and having a bifurcated head secured thereto.

5. The elevator work station of claim 4 additionally comprising a second base means secured to said stanchion members on a side opposed to said side where the base means secures to said stanchion members.

6. The elevator work station of claim 4 wherein said base means additionally comprises a pair of cross braces connected to the pair of hollow stanchion members and to the pair of opposed sides.

7. The elevator work station of claim 6 wherein said base means additionally comprises a base cross-support member secured to one of the opposed ends and having a pair of threaded feet threadably passing therethrough.

8. The elevator work station of claim 6 wherein said base means additionally comprises a base cross-support member secured to one of the opposed ends, said base cross-support member is hollow and open on its ends, and said base means further comprises a pair of support extension members slidably, telescopically passing into the open ends of the base cross-support member, and each support extension member comprises a threaded foot threadably passing therethrough.

9. The elevator work station of claim 8 wherein said work station means comprises a lower frame member and an upper frame member, a pair of lower roller bearings secured to said lower frame member and a pair of upper roller bearings secured to the upper frame member, said structural portion is a pair of lower bearing brackets rotatably supporting said lower roller bearings and a pair of upper bearing brackets rotatably supporting said upper roller bearings, and said lower roller bearings and said upper roller bearings rotatably travel within said hollow stanchion members.

10. The elevator work station of claim 6 wherein said base means additionally comprises a bracket member secured to each cross brace, each bracket member has a threaded engager passing therethrough, and said base means further comprises a base cross-support member slidably passing through each bracket member such as to be slidably flushed against one of the opposed ends.

11. The elevator work station of claim 10 wherein said base cross-support member is hollow and open on its ends, and said base means further comprises a pair of support extension members slidably telescopically passing into the open ends of the base cross-support member, and each support extension member comprises a threaded foot threadably passing therethrough.

12. The elevator work station of claim 11 wherein said work station means comprises a lower frame member and an upper frame member, a pair of lower roller bearings secured to said lower frame member and a pair of upper roller bearings secured to the upper frame member, said structural portion is a pair of lower bearing brackets rotatably supporting said lower roller bearings and a pair of upper bearing brackets rotatably supporting said upper roller bearings, and said lower roller bearings and said upper roller bearings rotatably travel within said hollow stanchion members.

13. The elevator work station of claim 6 wherein each of said opposed sides is hollow and open on one end, and said base means additionally comprises a pair of slide extension members slidably telescopically passing into the open end of the hollow opposed sides, and a cross-support member secured to the pair of slide extension members.

14. The elevator work station of claim 13 wherein said base cross-support member is hollow and open on its ends, and said base means further comprises a pair of support extension members slidably telescopically passing into the open ends of the base cross-support member, and each support extension member comprises a threaded foot threadably passing therethrough.

15. The elevator work station of claim 13 wherein said base cross-support member has a pair of threaded feet threadably passing therethrough.

16. The elevator work station of claim 15 wherein said work station means comprises a lower frame member and an upper frame member, a pair of lower roller bearings secured to said lower frame member and a pair of upper roller bearings secured to the upper frame member, said structural portion is a pair of lower bearing brackets rotatably supporting said lower roller bearings and a pair of upper bearing brackets rotatably supporting said upper roller bearings, and said lower roller bearings and said upper roller bearings rotatably travel within said hollow stanchion members.

17. The elevator work station of claim 16 wherein said work station means comprises at least one guide bearing secured to said lower frame.

18. The elevator work station of claim 16 wherein said means for raising and lowering said work station means comprises a gear sprocket, a hub bound to said gear sprocket, a pair of cables connected to said hub and to said top of said upright back; and a means for rotating said gear sprocket.

19. The elevator work station of claim 18 wherein said work station means includes a pair of rotating guide rollers wherearound said pair of cables pass.

20. The elevator work station of claim 18 wherein wherein said means for rotating said gear sprocket comprises a pair of pedals geared to said gear sprocket.

21. The elevator work station of claim 28 wherein said means for rotating said gear sprocket comprises a worm gear engaged by the pair of pedals, a horizontal gear geared to the worm gear and a vertical gear geared to the horizontal gear and to the gear sprocket.

22. The elevator work station of claim 21 wherein said work station movement control means comprises a manually operated lever, a sprocket lever pivotally situated such as to be capable of engaging the gear sprocket and a control cable connected to the manually operated lever and to the sprocket lever.

23. The elevator work station of claim 1 wherein said work station means comprises a lower frame member and an upper frame member, a pair of lower roller bearings secured to said lower frame member and a pair of upper roller bearings secured to the upper frame member, said structural portion is a pair of lower bearing brackets rotatably supporting said lower roller bearings and a pair of upper bearing brackets rotatably supporting said upper roller bearings, and said lower roller bearings and said upper roller bearings rotatably travel within said hollow stanchion members.

24. The elevator work station of claim 23 wherein said work station means comprises at least one guide bearing secured to said lower frame.

25. The elevator work station of claim 1 wherein said work station movement control means comprises a manually operated lever, a sprocket lever pivotally situated such as to be capable of engaging the gear sprocket and a control cable connected to the manually operated lever and to the sprocket lever.

* * * * *